US006774873B2

(12) United States Patent
Hsu et al.

(10) Patent No.: US 6,774,873 B2
(45) Date of Patent: Aug. 10, 2004

(54) METHOD FOR IMPLEMENTING ERROR DIFFUSION ON PLASMA DISPLAY PANEL

(75) Inventors: Liang-Kuei Hsu, Taipei (TW); Yao-Hung Lai, Taipei (TW); Shiuh-Bin Kao, Taipei (TW); Kuang-Lang Chen, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 291 days.

(21) Appl. No.: 09/870,493

(22) Filed: Jun. 1, 2001

(65) Prior Publication Data

US 2002/0186225 A1 Dec. 12, 2002

(30) Foreign Application Priority Data

Apr. 20, 2001 (TW) ..... 090109507

(51) Int. Cl.[7] ..... G09G 3/28

(52) U.S. Cl. ..... 345/60; 345/639; 345/640; 382/252; 382/237

(58) Field of Search ..... 345/60, 67, 63, 345/639, 640; 382/237, 252

(56) References Cited

U.S. PATENT DOCUMENTS 5,418,626 A * 5/1995 Semasa ..... 358/451
5,479,538 A * 12/1995 Takahashi ..... 382/270
5,710,836 A * 1/1998 Shiau et al. ..... 382/237
5,712,927 A * 1/1998 Kim et al. ..... 382/252
5,748,785 A * 5/1998 Mantell et al. ..... 382/237
5,754,706 A * 5/1998 Schweid et al. ..... 382/252
5,784,496 A * 7/1998 Mantell ..... 382/237
6,069,609 A * 5/2000 Ishida et al. ..... 345/596
6,310,588 B1 * 10/2001 Kawahara et al. ..... 345/63
6,552,736 B2 * 4/2003 Honda et al. ..... 345/691

* cited by examiner

*Primary Examiner*—Richard Hjerpe
*Assistant Examiner*—KimNhung Nguyen
(74) *Attorney, Agent, or Firm*—Bacon & Thomas, PLLC

(57) ABSTRACT

A method for implementing error diffusion on a plasma display panel (PDP) comprises the steps of performing an anti compensation process on a received video signal of the PDP; diffusing an error generated by a first one of a plurality of pixels to a plurality of adjacent pixels; absorbing errors generated by the plurality of adjacent pixels by the first pixel; and multiplying each of a plurality of numeric weightings and the error of each of the adjacent pixels to obtain an error function of the first pixel. This is effected in a cost effective while simple addition circuit for solving the problem of low level contouring in PDP due to insufficient gray scale of video signal in low gray scale.

12 Claims, 6 Drawing Sheets

=

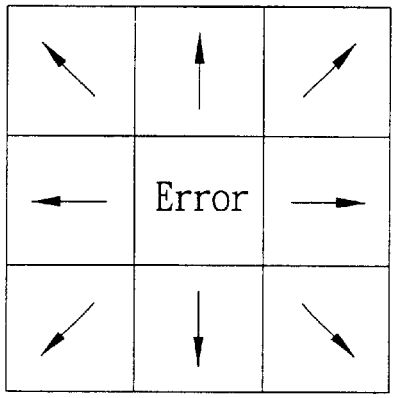
FIG. 4a
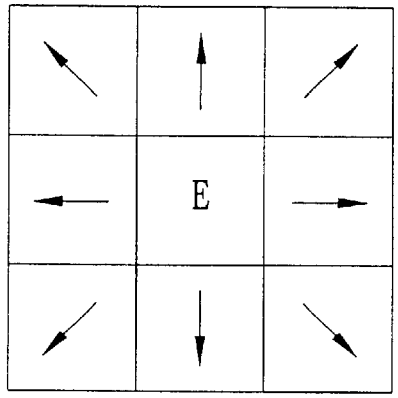
FIG. 4b
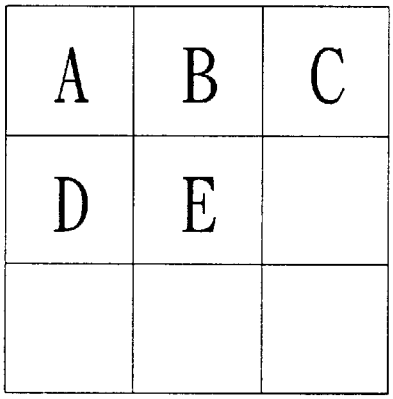
FIG. 5a
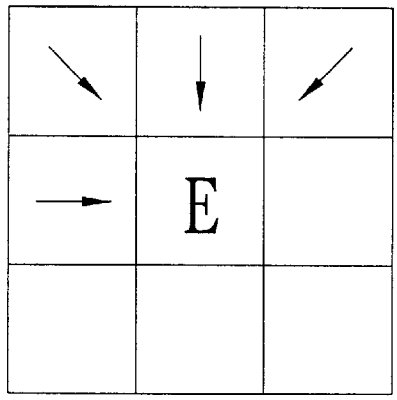
FIG. 5b
| | | |
|---|---|---|
| $\frac{1}{16}$ Err(A) | $\frac{5}{16}$ Err(B) | $\frac{3}{16}$ Err(C) |
| $\frac{7}{16}$ Err(D) | P | |
| | | |
FIG. 6

METHOD FOR IMPLEMENTING ERROR DIFFUSION ON PLASMA DISPLAY PANEL

FIELD OF THE INVENTION

The present invention relates to PDP (plasma display panels) and more particularly to a method for implementing error diffusion on PDP so as to solve low level contouring occurred thereon.

BACKGROUND OF THE INVENTION

The brightness of a typical color television (TV) may be expressed in following equation (1) in terms of input voltage by utilizing the physical characteristic of cathode ray tube (CRT) of color TV:

$$\text{brightness}=k\times(V_{INPUT}/V_{MAX})^{\gamma} \quad (1)$$

where $\gamma=2.2$, k is a variable representing gray scale of color TV (e.g., k=256 if gray scale of color TV is 256), $V_{INPUT}$ is input voltage varied as gray scale of color TV, and $V_{MAX}$ is a maximum voltage required for showing a maximum gray scale of color TV. Hence, the relationship of input gray scale versus output brightness of color TV may be plotted as a curve (FIG. 1*a*). Conventionally, prior to sending a video signal (e.g., NTSC or HDTV), a Gamma ($\gamma$) compensation process (called compensation process hereinafter) is performed on the original video signal by utilizing above physical characteristic thereof. That is, a compensation process is performed with respect to $\gamma$ in equation (1). As such, the relationship of input brightness versus output gray scale of color TV may be plotted as a curve (FIG. 1*b*). In one example of $\gamma=0.45$ (i.e., obtained from 1/2.2), the video signal received by color TV is converted into image for showing on screen of CRT of color TV. Hence, the relationship of input brightness versus output brightness of color TV may be plotted as a straight line (FIG. 1*c*). As a result, a high quality image is shown on the typical color TV without distortion.

As to recently available PDP (plasma display panels) brightness of respective discharge unit on panel thereof is controlled by discharge number. Hence, brightness may be expressed in following equation (2) in terms of discharge number as below (i.e., a straight line):

$$\text{brightness}=k_2\times\text{discharge number} \quad (2)$$

where $k_2$ is a variable representing gray scale of PDP (e.g., $k_2=256$ if gray scale of PDP is equal to 256). In view of this, the higher discharge number the brighter of PDP. This is similar to the effect that the larger input voltage the brighter of a typical color TV.

Referring to FIGS. 2*a*, 2*b* and 2*c*, a compensation process is performed on received video signal by PDP by substituting $\gamma=0.45$ into equation (1) by similarly utilizing the physical characteristic of typical color TV. As such, the relationship of input brightness versus output gray scale of PDP may be plotted as a curve (FIG. 2*a*). Further, the relationship of input gray scale versus output brightness of PDP may be plotted as a straight line (FIG. 2*b*). Furthermore, video signal received by PDP is converted into image for showing on screen of PDP. Hence, the relationship of input brightness versus output brightness of PDP may be plotted as a curve (FIG. 2*c*) by similarly substituting $\gamma=0.45$ into equation (1). As a result, a distorted image with poor contrast is shown on PDP.

Typically, an anti compensation process is performed for solving above drawbacks. In detail, in one example, an anti compensation process is performed on received video signal by PDP by substituting $\gamma=2.2$ into equation (1). As such, in PDP the relationship of input gray scale versus output gray scale may be plotted as a curve (FIG. 3*b*). In another example, an anti compensation process is performed on received video signal by PDP by substituting y=0.45 into equation (1). Hence, in PDP the relationship of input brightness versus output gray scale may be plotted as a curve (FIG. 3*a*). As to image shown on PDP, the relationship of input gray scale versus output brightness of PDP may be plotted as a straight line (FIG. 3*c*). By combining FIGS. 3*a*, 3*b* and 3*c*, in PDP the relationship of input brightness versus output brightness may be plotted as a straight line (FIG. 3*d*). In other words, a linear relationship exists between image shown on PDP and received video signal. As a result, a high quality image is shown on PDP without distortion.

As to current PDP, signal input/output and processing are done by a digital technique. Moreover, in most cases gray scale of PDP is expressed as a power of 2. For example, in PDP eight bits are needed for representing 256 gray scales. Typically, in performing a compensation process an analog-to-digital conversion is performed on video signal prior to substituting $\gamma=0.45$ into equation (1). Then an anti compensation process is performed by substituting $\gamma=2.2$ into equation (1) for effecting an inverse transform on video signal. Finally, an image is shown on PDP. As brightness of PDP is proportional to discharge number thereof. If brightness of one discharge of PDP is equal to N cd/m$^2$ (N is an integer) N is a minimum brightness of PDP. As such, brightness of PDP may be expressed as a multiple of one discharge of PDP. That is, brightness of PDP is a multiple of N. Hence, brightness of a plurality of k discharges is $k_3\times N$ (where $k_3$ is a positive integer). In other words, a brightness of $f\times N$ is not obtainable if f is not an integer (e.g., a brightness of $0.5\times N$).

In view of above, it is known that a brightness of PDP can not be expressed by a discharge number having a non-integer value (e.g., decimal). Hence, the decimal has to be converted into an integer. In the case of the original video signal having 256 gray scales, the number of gray scale is reduced to 184 after first being processed in an analog-to-digital conversion and subsequently by substituting $\gamma=2.2$ into equation (1) for performing an anti compensation process thereafter. In another case that the original video signal having a gray scale of 22, the number of gray scale is reduced to 1.62738 after an inverse transform is performed by substituting $\gamma=2.2$ into equation (1). Since decimal fraction of gray scale can not be shown on PDP only gray scale having value one rather than 1.62738 is shown on PDP (see Table I below.)

TABLE I

| gray scale of original video signal | gray scale after $\gamma$ = 2.2 conversion | gray scale of image shown on PDP |
|---|---|---|
| 1 | 0.001295 | 0 |
| 2 | 0.005949 | 0 |
| 3 | 0.014515 | 0 |
| . . . | . . . | . . . |
| 21 | 1.049625 | 1 |
| 22 | 1.162738 | 1 |
| . . . | . . . | . . . |
| 29 | 2.135145 | 2 |
| 30 | 2.30048 | 2 |
| . . . | . . . | . . . |
| 43 | 5.079049 | 5 |
| 44 | 5.342539 | 5 |

TABLE I-continued

| gray scale of original video signal | gray scale after γ = 2.2 conversion | gray scale of image shown on PDP |
|---|---|---|
| 45 | 5.613314 | 5 |
| . . . | . . . | . . . |
| 255 | 255 | 255 |
| Total gray scale = 256 | Total gray scale = 256 | Total gray scale = 184 |

Hence, a problem of insufficient gray scale of video signal is occurred in the range of low gray scale after such anti compensation process. And in turn a low level contouring is occurred in the range of low gray scale. Consequently, a poor contrast of gray scale is occurred in the range of low gray scale. This can degrade the image quality.

SUMMARY OF THE INVENTION

It is thus an object of the present invention to provide a method for implementing error diffusion on a plasma display panel (PDP) comprising the steps of: performing an anti compensation process on a received video signal of the PDP; diffusing an error generated by a first one of a plurality of pixels to a plurality of adjacent pixels; absorbing errors generated by the plurality of adjacent pixels by the first pixel; and multiplying each of a plurality of numeric weightings and the error of each of the adjacent pixels to obtain an error function of the first pixel. This utilizes a cost effective while simple addition circuit in implementing error diffusion for solving the problem of low level contouring in PDP due to insufficient gray scale of video signal in the range of low gray scale.

The above and other objects, features and advantages of the present invention will become apparent from the following detailed description taken with the accompanying drawings.

BRIEF DESCRIPTION OF THE DRAWINGS

FIG. 4*a* is a graph illustrating an error generated by a pixel being diffused to adjacent eight pixels implemented in a conventional technique;

FIG. 4*b* is a graph similar to FIG. 4*a* where errors generated by adjacent pixels are diffused to (i.e., absorbed by) a central pixel;

FIG. 5*a* is a graph illustrating nine adjacent pixels is simplified to five adjacent pixels;

FIG. 5*b* is a graph similar to FIG. 5*a* where errors generated by four adjacent pixels are diffused to (i.e., absorbed by) a central pixel;

FIG. 6 is a graph similar to FIG. 5*b* where errors generated by four adjacent pixels are weighted;

DETAILED DESCRIPTION OF THE PREFERRED EMBODIMENTS

Figure 1A:
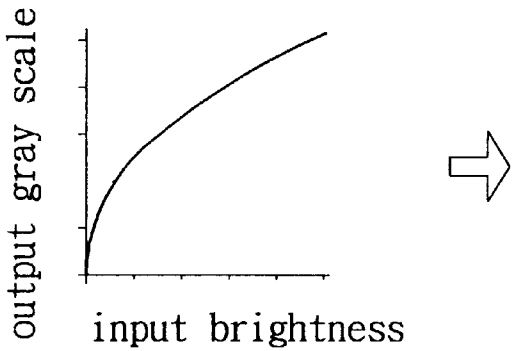
FIG. 1a (Prior Art)
FIG. 1*a* is a graph showing a relationship of input brightness versus output gray scale of a conventional color TV.
Figure 1B:
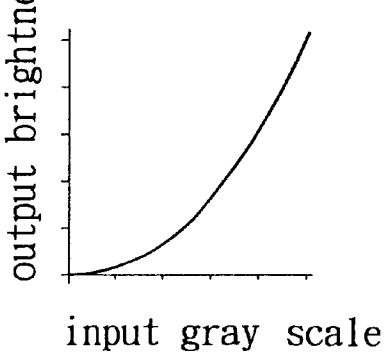
FIG. 1b (Prior Art)
FIG. 1*b* is a graph showing a relationship of input gray scale versus output brightness of the conventional color TV.
Figure 1C:
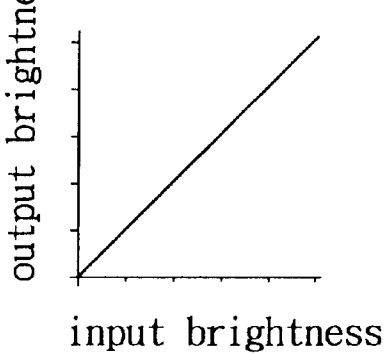
FIG. 1c (Prior Art)
FIG. 1*c* is a graph showing a relationship of input brightness versus output brightness of the conventional color TV.
Figure 2A:
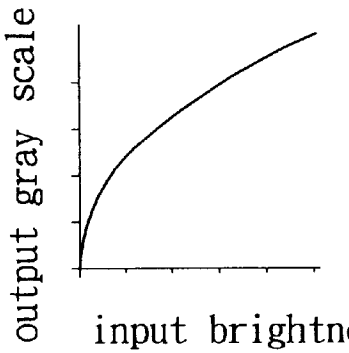
FIG. 2a (Prior Art)
FIG. 2*a* is a graph showing a relationship of input brightness versus output gray scale of a conventional plasma display panel (PDP)
Figure 2B:
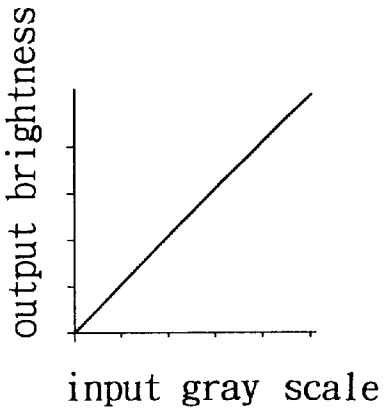
FIG. 2b (Prior Art)
FIG. 2*b* is a graph showing a relationship of input gray scale versus output brightness of the conventional PDP.
Figure 2C:
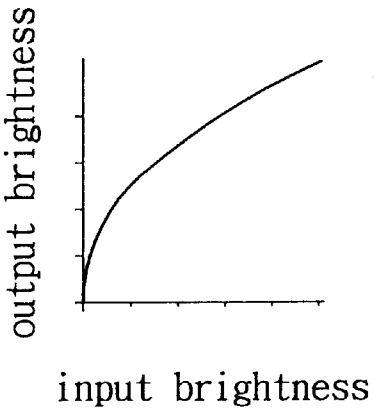
FIG. 2c (Prior Art)
FIG. 2*c* is a graph showing a relationship of input brightness versus output brightness of the conventional PDP.
Figure 3A:
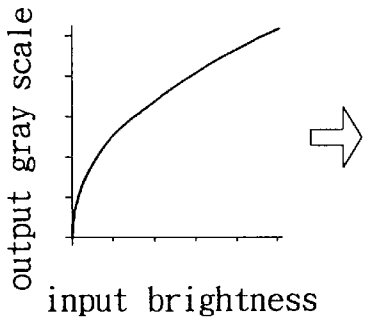
FIG. 3a (Prior Art)
FIG. 3*a* is a graph showing a relationship of input brightness versus output gray scale of the conventional PDP after an anti compensation process is performed thereon.
Figure 3B:
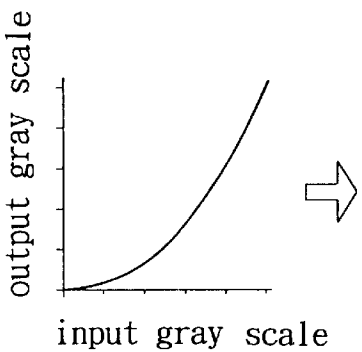
FIG. 3b (Prior Art)
FIG. 3*b* is a graph showing a relationship of input gray scale versus output gray scale of the conventional PDP after the anti compensation process is performed thereon.
Figure 3C:
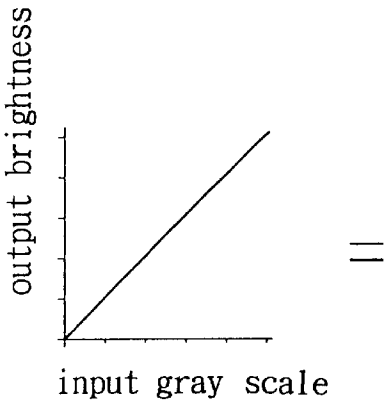
FIG. 3c (Prior Art)
FIG. 3*c* is a graph showing a relationship of input gray scale versus output brightness of the conventional PDP after the anti compensation process is performed thereon.
Figure 3D:
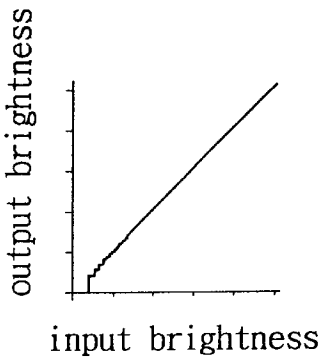
FIG. 3d (Prior Art)
FIG. 3*d* is a graph showing a relationship of input brightness versus output brightness of the conventional PDP after the anti compensation process is performed thereon.

Typically, for solving the problem of low level contouring in PDP due to insufficient gray scale of video signal in the range of low gray scale an error diffusion implementation is carried out for compensating the video signal of PDP. It is required to define error (see Table II) prior to carrying out such error diffusion implementation.

TABLE II

| gray scale of original video signal | gray scale after γ = 2.2 conversion |
|---|---|
| 0–14 | 0 |
| 15–24 | 1 |
| 25–31 | 2 |
| 32–36 | 3 |
| 37–40 | 4 |
| 41–44 | 5 |
| 45–48 | 6 |
| 49–51 | 7 |
| 52–54 | 8 |
| 55–57 | 9 |
| 58–59 | 10 |
| . . . | . . . |
| 255 | 255 |
| Total gray scale = 256 | Total gray scale = 184 |

For example, a video signal has a gray scale of I after first being processed in an analog-to-digital conversion. Subsequently γ=2.2 is substituted into equation (1) for performing an anti compensation process. As a result, gray scale of the video signal is reduced to 0.001295. As stated above, since decimal fraction of gray scale can not be shown on PDP only gray scale having value zero rather than 0.001295 is shown on PDP. That is, there is an error of 0.001295 in gray scale. Likewise, in another example a video signal has a gray scale of 30 after first being processed in an analog-to-digital conversion. Subsequently γ=2.2 is substituted into equation (1) for performing an anti compensation process. As a result, gray scale of the video signal is reduced to 2.30048. As stated above, since decimal fraction of gray scale can not be shown on PDP only gray scale having value two rather than 2.30048 is shown on PDP. That is, there is an error of 0.30048 in gray scale. In view of above, the generation of such error is totally caused by decimal fraction of gray scale which can not be shown on PDP (i.e., only integer gray scale is shown).

Referring to FIG. 4*a*, an error generated by a central pixel on PDP is diffused to adjacent eight pixels in a conventional technique. Likewise, errors generated by eight adjacent pixels are diffused to (i.e., absorbed by) the central pixel (FIG. 4*b*). Since each pixel can absorb errors generated by eight adjacent pixels the to be rounded decimal fraction of gray scale may carry forward to become an integer due to the addition of errors of eight adjacent pixels in the process of anti compensation. In other words, such decimal fraction of gray scale is not rounded as expected. Hence, the obtained gray scale is not correct. Further, a practical circuit for implementing error diffusion on PDP is also considered. In a typical technique, nine adjacent pixels is simplified to five adjacent pixels (e.g., A, B, C, D, and E in FIGS. 5*a* and 5*b*). In addition, errors generated by pixels A, B, C and D are diffused to (i.e., absorbed by) the central pixel E. For obtaining an optimum visual effect by such error diffusion, a suitable numeric weighting is multiplied by each pixel having a different location. For example, $1/16$, $5/16$, $3/16$ and $7/16$ are multiplied by pixels A, B, C and D respectively (FIG. 6). Hence, gray scale P' of pixel E after error diffusion implementation may be expressed as an addition of original gray scale P and error function Err(f) in a following equation 3:

$$P'=P+Err(f) \tag{3}$$

where error function Err(f) is expressed as an addition of four adjacent pixels each of which is a multiplication of an associated weighting and error function thereof in a following equation 4:

$$Err(f)=1/16Err(A)+5/16Err(B)+3/16Err(C)7/16Err(D)$$

Figure 7:
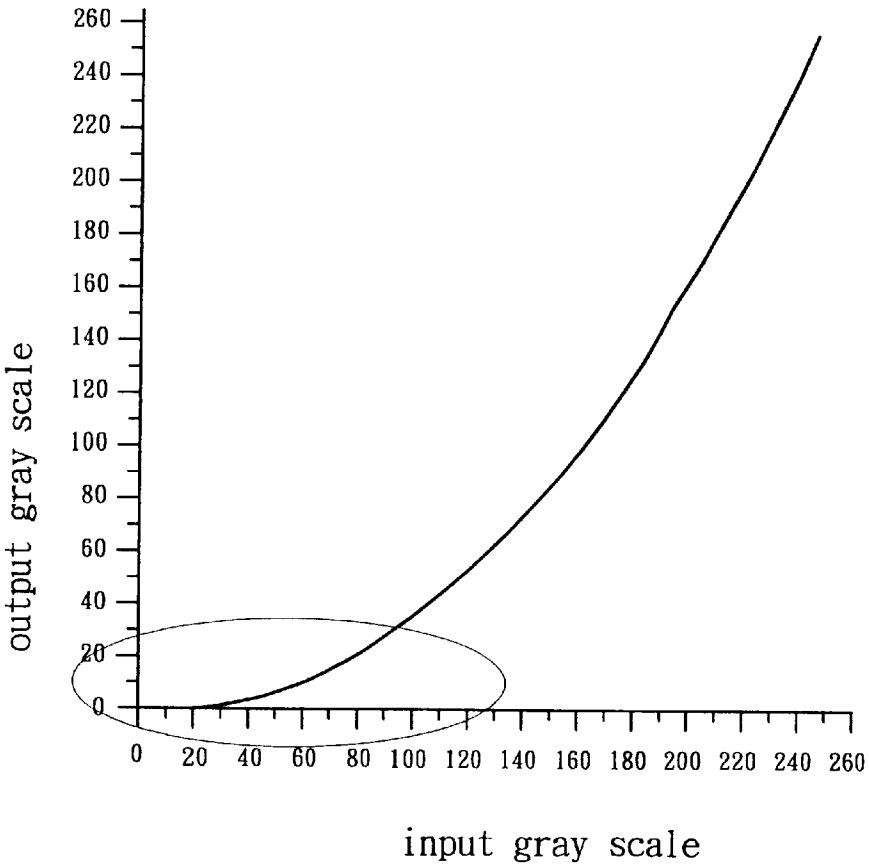
FIG. 7 is a graph showing a relationship of input gray scale versus output gray scale obtained in the conventional technique.
Figure 8:
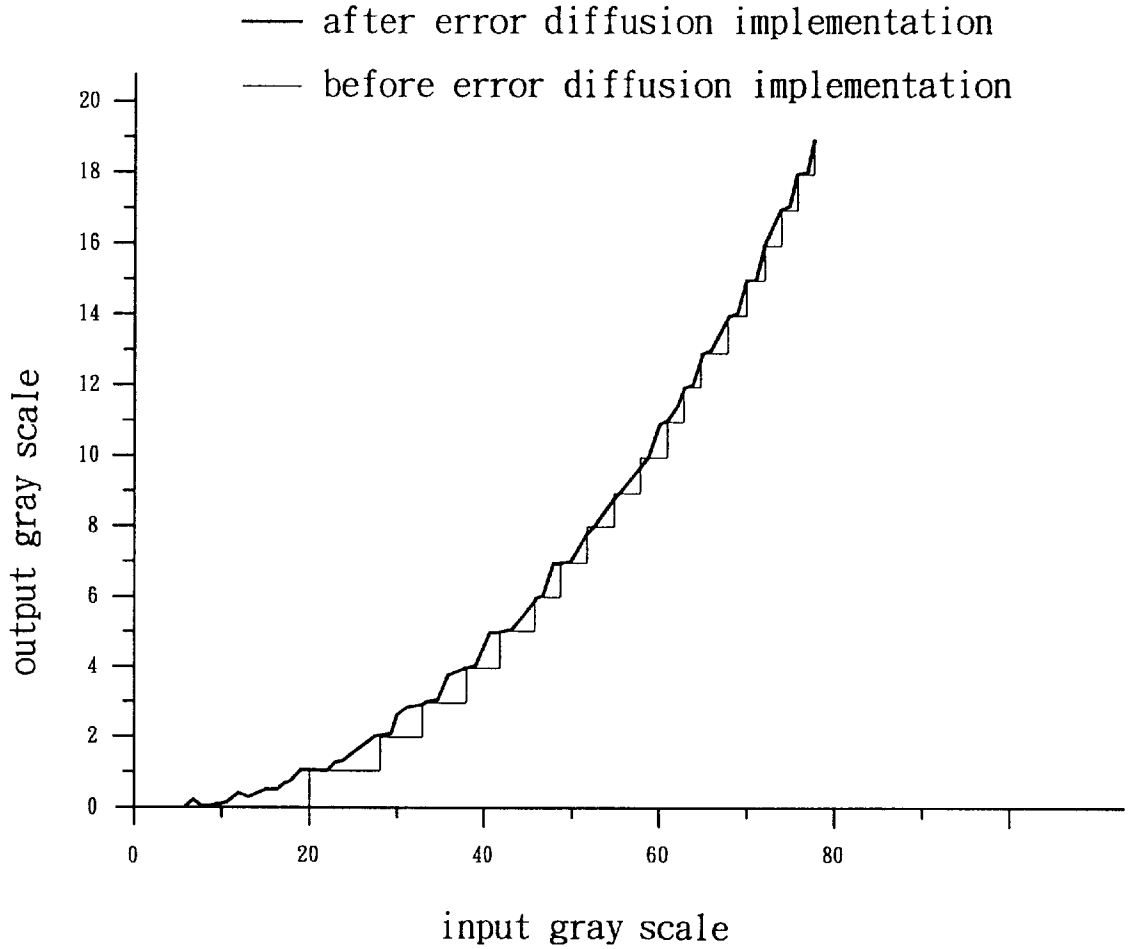
FIG. 8 is an enlarged graph of a portion of FIG. 7 showing a relationship of input gray scale versus output gray scale where curves before error diffusion implementation (i.e., in prior art) and after error diffusion implementation (i.e., in a method according to the invention) are plotted for comparison.

The variation of gray scale of video signal before and after error diffusion implementation on PDP may be best illustrated by referring to FIG. 7. In FIG. 7, a graph shows a relationship of input gray scale versus output gray scale after performing a Gamma anti compensation on video signal. Unfortunately, it is not possible to observe a significant variation of gray scale of video signal in the whole range of gray scale before and after error diffusion are implemented. A curve portion in the range of gray scale of 0 to 80 is enlarged in FIG. 8 for further illustrating a relationship of input gray scale versus output gray scale. As shown, a zigzag line is obtained by substituting $\gamma=2.2$ into equation (1) for performing an anti compensation process. It is observed that there is a discontinuity in the low gray scale portion which in turn causes a low level contouring of image. In comparison, a bold line is obtained by substituting $\gamma=2.2$ into equation (1) for performing an anti compensation process and an error diffusion is further implemented on the line. It is observed that this bold line is substantially continuous and smooth. As a result, the low level contouring of image is much improved.

In a practical technique, an additional multiplication circuit is required to incorporate into a control circuit of PDP for carrying out the error diffusion implementation as expressed in equations 3 and 4. However, it requires a complex multiplication circuit design, resulting in an increase of manufacturing difficulty.

For solving above problem, a method for implementing error diffusion on PDP is carried out wherein weighting as represented conventionally by decimal is converted into one other than above by the invention. This utilizes an addition circuit in a cost effective and simple manner as detailed below.

Referring to FIGS. 5*a* and 5*b* again, for obtaining an optimum visual effect by error diffusion implementation, pixel E may absorb errors generated by adjacent pixels A, B, C and D. Further, a suitable weighting is multiplied by each of pixels A, B, C and D respectively. Hence, error function Err(f) may be expressed in a following equation 5:

$$Err(f)=\mathrm{w1}Err(A)+\mathrm{w2}Err(B)+\mathrm{w3}Err(C)+\mathrm{w4}Err(D) \tag{5}$$

where each of w1, w2, w3, and w4 is a weighting of the associated pixel. In a preferred embodiment of the invention, each of w1, w2, w3, and w4 may be represented by a negative power of integer (e.g., 2) or an addition of a plurality of ones each having a negative power of integer (e.g., 2). For example, $\mathrm{w1}=1/16=2^{-4}$, $\mathrm{w2}=5/16=1/16+2/16+2/16=1/16+1/4=2^{-4}+2^{-2}$, $\mathrm{w3}=3/16=1/16+2/16=1/16+1/8=2^{-4}+2^{-3}$, and $\mathrm{w4}=7/16=1/16+2/16+4/16=1/16+1/8+1/4=2^{-4}+2^{-3}+2^{-2}$. By substituting above w1, w2, w3 and w4 into equation 5, error function Err(f) may be expressed in a following equation 6:

$$Err(f)=2^{-4}Err(A)+(2^{-4}+2^{-2})Err(B)+(2^{-4}+2^{-3})Err(C)+(2^{-4}+2^{-3}+2^{-2})Err(D) \tag{6}$$

By comparing equations 6 and 4, it is found that each of weightings as represented conventionally by decimal is converted into a negative power of integer 2 or an addition of a plurality of ones each having a negative power of integer 2 by the invention. This utilizes a cost effective while simple addition circuit in implementing error diffusion, resulting in an elimination of error caused by decimal of gray scale as experienced in prior art.

Since picture shown at one time is different from that shown at the other time (i.e., dynamic picture), one error generated by a pixel in one picture may be different from that generated by the same pixel in the other picture. Hence, in another preferred embodiment of a method for implementing error diffusion on PDP according to the invention, a time varying weighting function (e.g., d1(t), d2(t), d3(t), or d4(t)) is multiplied by the associated numeric weighting. Hence, error function Err(f) may be expressed in a following equation 7:

$$Err(f)=\mathrm{w1}d1(t)Err(A)+\mathrm{w2}d2(t)Err(B)+\mathrm{w3}d3(t)Err(C)+\mathrm{w4}d4(t)Err(D) \tag{7}$$

As a result, an optimum image is shown on PDP.

While the invention has been described by means of specific embodiments, numerous modifications and variations could be made thereto by those skilled in the art without departing from the scope and spirit of the invention set forth in the claims.

What is claimed is:

1. A method for implementing error diffusion on a plasma display panel (PDP) comprising the steps of:

(a) performing an anti compensation process on a received video signal of said PDP;

(b) diffusing an error generated by a first one of a plurality of pixels to a plurality of adjacent pixels;

(c) absorbing errors generated by said plurality of adjacent pixels by said first pixel; and (d) multiplying each of a plurality of numeric weightings and said error of each of said adjacent pixels to obtain an error function of said first pixel, wherein each of said weightings is represented by a negative power of an integer.

2. The method of claim 1, wherein said error diffusion implementation is carried out by an addition circuit in said PDP.

3. A method for implementing error diffusion on a plasma display panel (PDP) comprising the steps of:

(a) performing an anti compensation process on a received video signal of said PDP;

(b) diffusing an error generated by a first one of a plurality of pixels to a plurality of adjacent pixels;

(c) absorbing errors generated by said plurality of adjacent pixels by said first pixel; and (d) multiplying each of a plurality of numeric weightings and said error of each of said adjacent pixels to obtain an error function of said first pixel, wherein each of said weightings is represented by a plurality of ones each having a negative power of an integer.

4. The method of claim 1, wherein in each of steps (b) and (c) the number of said plurality of adjacent pixels is eight.

5. The method of claim 1, wherein in each of steps (b) and (c) the number of said plurality of adjacent pixels is four.

6. A method for implementing error diffusion on a plasma display panel (PDP) comprising the steps of:

(a) performing an anti compensation process on a received video signal of said PDP;

(b) diffusing an error generated by a first one of a plurality of pixels to a plurality of adjacent pixels;

(c) absorbing errors generated by said plurality of adjacent pixels by said first pixel; and (d) multiplying each of a plurality of numeric weightings and said error of each of said adjacent pixels to obtain an error function of said first pixel, wherein each of said weightings is further multiplied by a time varying weighting function.

7. The method of claim 3, wherein said error diffusion implementation is carried out by an addition circuit in said PDP.

8. The method of claim 3, wherein in each of steps (b) and (c) the number of said plurality of adjacent pixels is eight.

9. The method of claim 3, wherein in each of steps (b) and (c) the number of said plurality of adjacent pixels is four.

10. The method of claim 6, wherein said error diffusion implementation is carried out by an addition circuit in said PDP.

11. The method of claim 6, wherein in each of steps (b) and (c) the number of said plurality of adjacent pixels is eight.

12. The method of claim 6, wherein in each of steps (b) and (c) the number of said plurality of adjacent pixels is four.

* * * * *